310-800 SR
9/27/83 XR 4,406,323

United States Patent [19]
Edelman

[11] 4,406,323
[45] Sep. 27, 1983

[54] PIEZOELECTRIC HEAT EXCHANGER

[76] Inventor: Seymour Edelman, 9115 Glenridge Rd., Silver Spring, Md. 20910

[21] Appl. No.: 342,476

[22] Filed: Jan. 25, 1982

[51] Int. Cl.[3] ..... F28F 13/02; F28F 13/12
[52] U.S. Cl. ..... 165/84; 165/109 R; 310/800
[58] Field of Search ..... 165/84, 109 R; 310/800

[56] References Cited

U.S. PATENT DOCUMENTS

| | | | |
|---|---|---|---|
| 2,514,797 | 7/1950 | Robinson | 165/84 |
| 2,664,274 | 12/1953 | Worn et al. | 165/84 |
| 2,937,500 | 5/1960 | Bodine, Jr. | 165/84 X |
| 3,814,172 | 6/1974 | Shore | 165/84 X |
| 4,234,245 | 11/1980 | Toda et al. | 310/800 X |
| 4,283,461 | 8/1981 | Wooden et al. | 310/800 X |

FOREIGN PATENT DOCUMENTS

| | | | |
|---|---|---|---|
| 532144 | 1/1941 | United Kingdom | 165/109 R |

*Primary Examiner*—Sheldon J. Richter
*Attorney, Agent, or Firm*—Brady, O'Boyle & Gates

[57] ABSTRACT

Apparatus is disclosed for providing increased heat transfer efficiency in a heat exchanger by separating contiguous fluid conductive channels by means of a flexible partition of a bimorph construction consisting of two adjacent layers of piezoelectric material arranged so that, when an electrical signal is applied, one layer expands while the other contracts causing the composite sheet to flex and push a sub-laminar layer of the fluid located adjacent to the sheet away into the turbulent stream while drawing other fluid into contact with the partition. The preferred embodiment of the invention additionally includes a grid or mesh member between the two layers for strengthening the partition so that it can withstand a relatively large pressure gradient thereacross.

15 Claims, 6 Drawing Figures

FIG.1
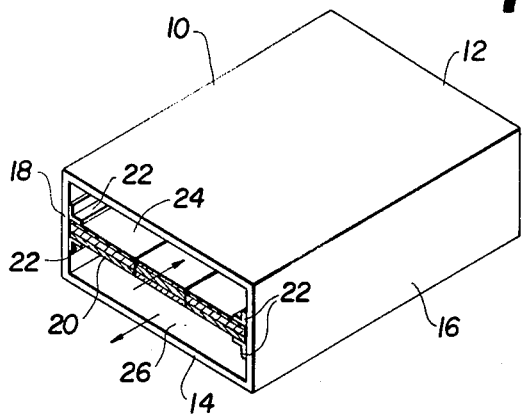
FIG.2
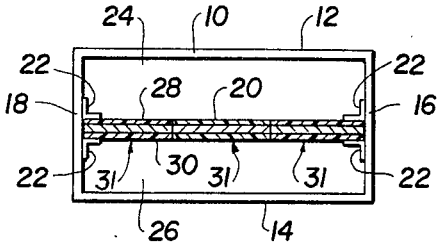
FIG.3
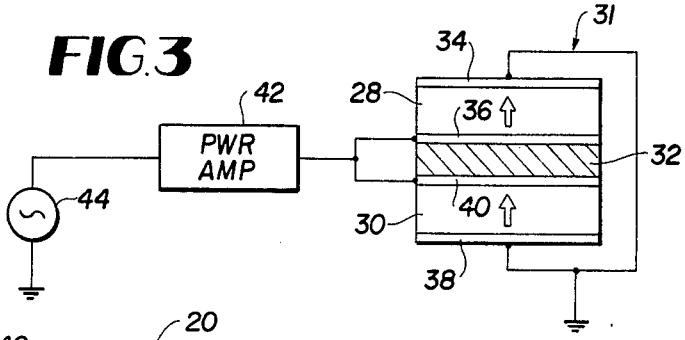
FIG.4
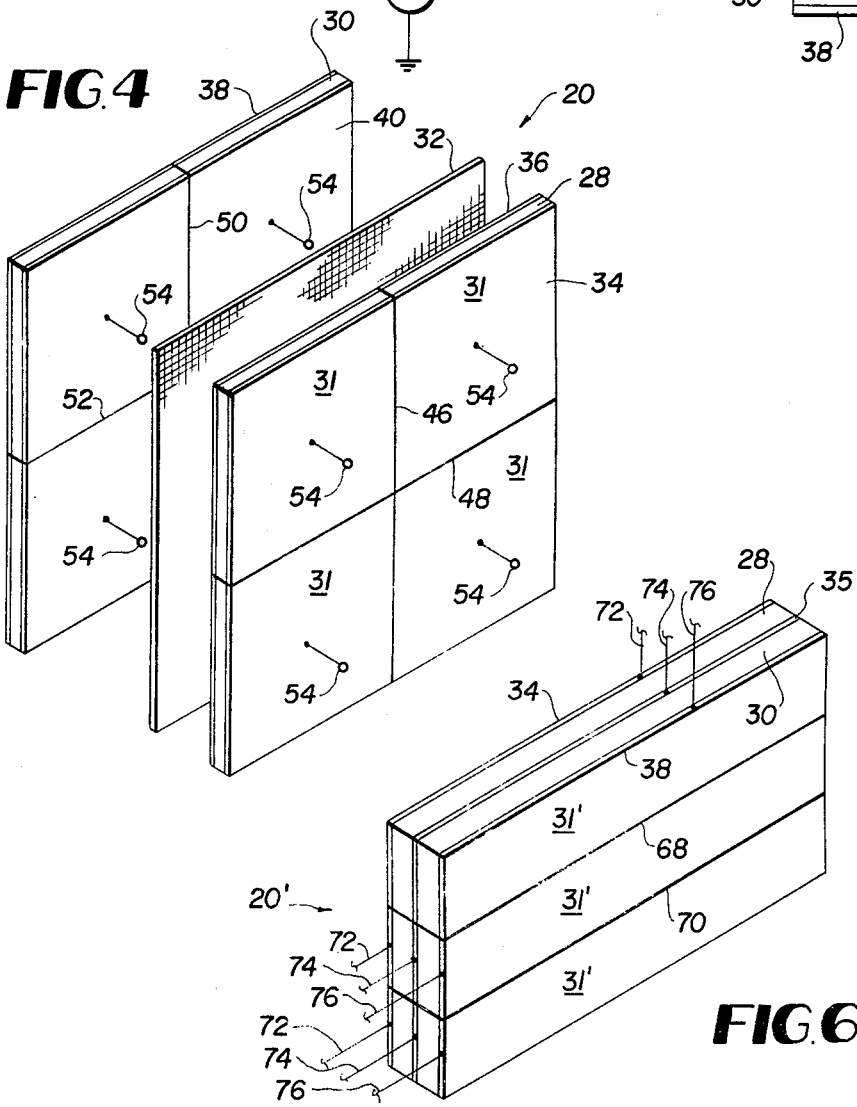
FIG.5
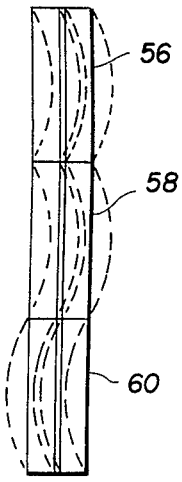
FIG.6

PIEZOELECTRIC HEAT EXCHANGER

BACKGROUND OF THE INVENTION

This invention relates generally to apparatus for providing heat transfer between two fluids of different temperature separated by a heat conducting barrier or partition and more particularly to a means for providing an increase in the heat transfer efficiency across the partition.

Heat exchangers are well known in the state of the art; however, a principal impediment to effective transfer or transmission of heat from a warm fluid to a cold fluid is the boundary layer of fluid which adheres to each side of the partition or barrier separating the two fluids. Even when the motions of the fluid are fully turbulent, there exists a laminar sub-layer which operates to obstruct the transmission of heat, which obstruction often is greater than that provided by the partition itself. While various methods and types of apparatus have been suggested in the past for overcoming the problem, such as by means of driving the fluid with sonic waves and vibrating the partition with external vibration generators, these measures while being partially effective at best are inherently limited in their ability to generate a motion which is particularly adapted to minimize the thickness of the laminar sub-layer on each side of the partition. The inventor of this invention has previously proposed a solution which is shown and described in U.S. patent application Ser. No. 030,966 filed on Mar. 17, 1979, entitled, "Piezoelectric Polymer Heat Exchanger," wherein there is shown and described a single or unitary flexible sheet of piezoelectric material which is utilized as the barrier or partition between two heat exchanger channels. The flexible piezoelectric sheet there additionally includes a pattern of electrodes to which is applied an alternating current electrical signal having a frequency substantially equal to the natural frequency of the partition, which when applied, causes the sheet to flex at its resonance frequency and in so doing, sets up a standing wave or traveling wave pattern, causing a wave or flipping motion to occur which pushes the sub-laminar layer away from the piezoelectric sheet.

Accordingly, it is an object of the present invention to provide an improvement in apparatus for increasing the efficiency of heat transfer in a fluid heat exchanger.

It is yet another object of the present invention to provide improvement in apparatus for promoting the flow of fluids within a heat exchanger.

Still a further object of the invention is to provide an improvement in the partition or barrier separating the two fluids in a heat exchanger.

SUMMARY

Briefly, the subject invention is directed to a heat exchanger having at least two fluid conductive channels separated by a heat conductive partition wherein the partition is comprised of a double sheet of piezoelectric material arranged in a bimorph configuration so that when an electrical signal is applied to one sheet, it expands and when electrical signal is applied simultaneously to the other sheet, it contracts causing the sheet to flex. The bimorph partition is driven so that a pumping action occurs to push the sub-laminar layer away from the sheet to which it is adjacent into the turbulent stream while drawing other fluid into contact with the partition. The partition also includes an intermediate grid or mesh type member which is bonded between the two layers for strengthening the partition so that it can withstand a relatively large pressure gradient across the partition. The two sheets of piezoelectric material can be fabricated not only from a piezoelectric polymer, but also crystalline, poly-crystalline, ceramic piezoelectric material or a dispersion of piezoelectric ceramic particles in a polymer matrix. The bimorph configuration is inherently more efficient because it provides a greater motion against fluid pressure than heretofore obtainable.

BRIEF DESCRIPTION OF THE DRAWINGS

FIG. 1 is a perspective view broadly illustrative of a dual flow fluid heat exchanger in accordance with the subject invention;

FIG. 2 is an end planar view of the heat exchanger shown in FIG. 1;

FIG. 3 is an electrical schematic diagram illustrative of the manner in which the piezoelectric fluid partition shown in FIGS. 1 and 2 is electrically energized;

FIG. 4 is an exploded perspective view of the preferred embodiment of the piezoelectric partition shown in FIG. 3;

FIG. 5 is a diagram illustrative of the operation of the piezoelectric partition shown in FIG. 4; and FIG. 6 is a perspective view of a second embodiment of a heat exchanger partition in accordance with the subject invention.

DESCRIPTION OF THE PREFERRED EMBODIMENTS

Referring now to the drawings, wherein like reference numerals refer to like parts, and more particularly to FIGS. 1 and 2, there is disclosed a basic two channel heat exchanger substantially rectangular in transverse cross-section. The heat exchanger is comprised of a housing 10, commonly referred to as a shell which consists of a pair of generally flat top and bottom broad walls 12 and 14 and a pair of substantially flat narrower side walls 16 and 18. The interior of the housing 10 is substantially divided in half lengthwise by a generally flat partition or barrier 20 of uniform thickness and cross section spanning the side walls 16 and 18. The partition 20 is held in place between the side walls 16 and 18 by longitudinally extending right angle channel members 22 and defines a pair of contiguously adjacent fluid conductive channels 24 and 26, one of which is adapted to transport a warm fluid while the other conducts a cold fluid. Additionally, as shown in FIG. 1, the fluid flowing in channel 24 is intended to flow in one direction, while the fluid in channel 26 is adapted to flow in the opposite direction. This, however, is merely a matter of choice, since when desirable, both fluids can be made to flow in the same direction, as long as heat transfer can be achieved between the fluids through the partition 20.

Directing attention now to the inventive concept of this invention, the partition 20 is of an improved construction and is comprised of a bimorph configuration of piezoelectric material consisting of two layers 28 and 30 of piezoelectric material whose electrical characteristics are arranged so that when an electrical signal is applied across the two layers, one layer for example layer 28, expands while the other layer 30 contracts, causing the composite double sheet configuration to flex. As shown in FIGS. 1 and 2, the partition 20 is separated into individual sections 31 which are adapted to be separately excited. Examples of the separation pattern are shown in FIGS. 4 and 6 and accordingly individual flexure of the sections 31 can be achieved to create any desired motion which operates to push the sub-laminar layer of fluid adjacent to the outer surfaces of the partition away into the turbulent flow stream while drawing other fluid into contact with the partition. The upper and lower planar layers or sheets 28 and 30 are of substantially equal uniform thickness and are fabricated from any desired piezoelectric material. While the preferred material consists of a piezoelectric polymer, for example, polyvinylidene fluoride, the piezoelectric layer or sheet elements 28 and 30 can be fabricated from crystalline, polycrystalline, ceramic piezoelectric material or a dispersion of piezoelectric ceramic particles in a polymer matrix. In a preferred embodiment, the two piezoelectric layers 28 and 30 shown in FIGS. 1 and 2 are separated by and bonded to a grid or mesh member 32 fabricated, for example, from metal or plastic which is adapted to provide increased structural strength so that the partition in its composite form is able to withstand a relatively large pressure gradient thereacross.

Each of the plurality of bimorph sections 31 of the partition 20 is separately electrically energized in accordance with the schematic diagram shown in FIG. 3. Referring now to FIG. 3, each of the two piezoelectric layers 28 and 30 are shown having a pair of mutually opposing outer conductive surfaces. More particularly, the upper layer 28 includes the conductive surfaces 34 and 36 while the lower layer 30 includes the conductive surfaces 38 and 40. The conductive surfaces 34 and 38 comprise the outermost surfaces of the composite structure, while the surfaces 36 and 40 comprise surfaces which are bonded, for example by cement, to the grid member 32. Moreover, the outer and inner surfaces are electrically connected together with the surfaces 34 and 38 being shown connected to a reference or ground potential while the surfaces 36 and 40 are shown connected to the output of a power amplifier 42 whose input is connected to the ungrounded side of an electrical signal generator 44. The opposite side of the electrical signal generator 44 is connected to ground, thus completing an electrical circuit. The polarity of the two piezoelectric layers are, moreover, oriented in the same direction as shown by the arrows. According, when an electrical potential is applied from the generator 44 through the amplifier 42, one of the elements expands while the other contracts, causing the combination of both layers 28 and 30 to flex in the same direction as determined by the instantaneous electrical polarity of the applied signal. The bimorph configuration shown and described permits substantially greater motion against fluid pressure than heretofore available in known prior art apparatus and permits local areas to be driven separately so that a pumping action can be achieved and is furthermore more adapted to the use of piezoelectric materials other than polymers.

The manner in which local areas, i.e. bimorph sections 31, can be driven separately is shown in FIGS. 4 and 6. With respect to the embodiment shown in FIG. 4, which is the preferred embodiment, and is the one including the intermediate wire mesh member 20 located between the two layers of piezoelectric material 28 and 30, what is significant about the embodiment is the division of the partition 20 into discrete square rectangular areas or sections 31, four of which are shown, and being electrically isolated from one another, for example by means of vertical and horizontal insulating strips 46, 48, 50 and 52. These insulating members permit the individual sections 31 to be separately excited from individual signal sources, not shown, but like that which is shown in FIG. 3. Accordingly, the conductive surfaces 34, 36, 38 and 40 of the individual bimorph sections have electrical terminals 54 provided on both sides of the respective layers for receiving energizing potentials thereacross. When the various rectangular bimorph sections of the partition 20 are selectively energized, any desired flexual pattern can be established. For example as shown in FIG. 5, two adjacent sections 56 and 58 may be made to flex outwardly simultaneously while the section 60 can be made to flex inwardly. Typically, what is generated is a wave or flipping motion which is adapted to push the sublaminar layer of the fluid into the turbulent stream while drawing the other fluid into contact with the partition surface.

While the configuration shown in FIG. 4 is at present considered to be the preferred embodiment of the invention, when desirable, other modifications may be resorted to. For example, the embodiment shown in FIG. 6 is intended to illustrate a bimorph partition 20' which does not include the strengthening mesh element 32. As shown in FIG. 6, two piezoelectric layers 28 and 30 are bonded directly together so that a common conductive interface 35 is provided while having separate outer conductive surfaces 34 and 38. Whereas the structure shown in FIG. 4 includes rectangular bimorph sections 31', the configuration of FIG. 6 is intended to show a plurality of elongated longitudinally oriented rectangular sections having parallel insulator members 68 and 70 permitting individual excitation of the bimorph sections 31'. Accordingly, each section 31' includes three electrical leads 72, 74 and 76 connected to terminals, not shown, for the application of excitation voltages in a manner heretofore described.

Where a periodic motion is generated along the length of the partition 20, as each bimorph section 31 or 31' flexes toward the fluid stream in the channels 24 and 26, the fluid in contact with the partition surface is pushed toward midstream where both the mean motion and the turbulence are greatest and thereby providing the greatest tendency to mix the fluid in the sub-laminar layer with the turbulent fluid. While the fluid in the siub-laminar layer is still moving toward the center of the channel, one or more of the sections reverses their motion and begin to move back toward a neutral position. The inertia of the fluid in the sub-laminar layer will tend to cause separation from the partition and in the ideal case, leaving only those molecules which are in intimate contact with the partition surface to continue to move with it, thus reducing the thickness of the laminar sub-layer to molecular dimensions. As each section passes a neutral position and begins moving towards the other channel, the available volume becomes greater and fluid from all sides is driven in by the pressure gradient and the diffusion until the motion of the partition stops and reverses, causing even more mixing of the boundary layer with the turbulent fluid and thus causing intimate contact between the partition and the fluid.

Thus what has been shown and described is an improvement in heat exchanger apparatus utilizing a piezoelectric partition wherein the partition is of a bimorph construction of piezoelectric material and wherein the bimorph construction provides a greater motion against fluid pressure as well as providing a greater adaptability for being fabricated by a wide variety of piezoelectric materials.

It should be noted that the foregoing detailed description has been made by way of illustration and not limitation. Accordingly, it is not desired that the invention be limited to the specific arrangements shown and described, since other modifications and changes will readily occur to those skilled in the art, but is intended to cover all such modifications, and alterations which come within the spirit and scope of the invention as defined in the appended claims.

I claim as my invention:

1. A heat exchanger, comprising in combination:

means providing at least two fluid conductive channels and including a heat conductive partition between said channels, said partition consisting of a bimorph configuration of at least two layers of piezoelectric material mutually arranged so that one of said layers expands while the other of said layers contracts upon being electrically energized, whereupon said partition flexes in a predetermined direction within said channels in order to push the sub-laminar layer of fluid adjacent to the partition away into a turbulent stream flowing in said channels while drawing other fluid into contact with the partition and thus increase the efficiency of heat transmission between said channels; and means coupled to said bimorph configuration for energizing said at least two layers.

2. The heat exchanger as defined by claim 1 wherein said piezoelectric material comprises a piezoelectric polymer.

3. The heat exchanger as defined by claim 1 wherein said piezoelectric material is comprised of a crystalline or poly-crystalline piezoelectric material.

4. The heat exchanger as defined by claim 1 wherein said piezoelectric material comprises a ceramic piezoelectric material.

5. A heat exchanger as defined by claim 1 wherein said piezoelectric material comprises a dispersion of ceramic piezoelectric particles in a polymer matrix.

6. A heat exchanger as defined by claim 1 and additionally including a strengthening member located between said two layers of piezoelectric material.

7. The heat exchanger as defined by claim 6 wherein said strengthening member comprises a grid or mesh bonded between said two layers of piezoelectric material.

8. The heat exchanger as defined by claim 1 wherein said two layers of piezoelectric material respectively include mutually opposing electrically conductive surfaces and wherein said means for energizing said two layers are respectively coupled to said electrically conductive surfaces.

9. The heat exchanger as defined by claim 8 wherein said two layers of piezoelectric material and their respective mutually opposing conductive surfaces are configured to include a plurality of independently operable bimorph sections, and wherein said means for energizing said two layers comprises means selectively coupled to said plurality of bimorph sections for independently energizing said sections to provide a predetermined flexural motion pattern for urging any sub-laminar fluid layer contiguous to the surface of said sections into the stream of fluid flowing in said conductive channels while drawing other fluid into contact therewith.

10. The heat exchanger as defined by claim 9 wherein said bimorph sections are generally of a rectangular planar configuration.

11. The heat exchanger as defined by claim 9 wherein said two layers of piezoelectric material are bonded together and wherein one of said electrical conductive surfaces thereof forms a common interface.

12. The heat exchanger as defined by claim 9 and additionally including a strengthening member bonded between said two layers.

13. The heat exchanger as defined by claim 12 wherein said strengthening member comprises a grid or mesh member.

14. The heat exchanger as defined by claim 1 wherein said two layers of piezoelectric material are of a substantially equal uniform thickness.

15. The heat exchanger as defined by claim 1 wherein said two layers of piezoelectric material include mutually opposing outer conductive planar surfaces, wherein the polarity of said two layers are in the same direction, and wherein said means for energizing said two layers comprises means coupling one side of an energizing source commonly to the outer conductive surface and the other side of said energy source to the inner conductive surface.

* * * * *